US010575653B2

(12) United States Patent
DeFranks et al.

(10) Patent No.: US 10,575,653 B2
(45) Date of Patent: Mar. 3, 2020

(54) MATTRESS ASSEMBLY INCLUDING THERMALLY CONDUCTIVE FOAM LAYER

(71) Applicant: DREAMWELL, LTD., Las Vegas, NV (US)

(72) Inventors: Michael S. DeFranks, Atlanta, GA (US); Michael A. Golin, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 230 days.

(21) Appl. No.: 15/083,332

(22) Filed: Mar. 29, 2016

(65) Prior Publication Data

US 2016/0286972 A1 Oct. 6, 2016

Related U.S. Application Data

(60) Provisional application No. 62/141,373, filed on Apr. 1, 2015.

(51) Int. Cl.
*A47C 21/04* (2006.01)
*A47C 27/14* (2006.01)

(52) U.S. Cl.
CPC ..... *A47C 21/046* (2013.01); *A47C 27/14* (2013.01)

(58) Field of Classification Search
CPC ..... A47C 21/046; A47C 27/14; A47C 27/15
See application file for complete search history.

(56) References Cited

U.S. PATENT DOCUMENTS 4,683,246 A 7/1987 Davis et al.
5,568,659 A * 10/1996 Fogel ..... A47C 27/05 5/500
5,722,482 A * 3/1998 Buckley ..... A61F 7/02 165/10

(Continued)

FOREIGN PATENT DOCUMENTS

CN 101453925 A 6/2009
CN 103705031 A 4/2014

(Continued)

OTHER PUBLICATIONS

Notification of Transmittal of the International Search Report and the Written Opinion of the International Searching Authority, or the Declaration, issued in International Application No. PCT/US2016/024928, dated Jun. 6, 2016; 6 pages.

(Continued)

*Primary Examiner* — Nicholas F Polito
*Assistant Examiner* — Rahib T Zaman
(74) *Attorney, Agent, or Firm* — Cantor Colburn LLP

(57) ABSTRACT

Mattress assemblies and processes that provide user comfort include at least one thermally conductive foam layer consisting essentially of a polymeric elastomer foam matrix and a plurality of thermally conductive particles disposed therein, wherein the plurality of thermally conductive particles are selected from the group consisting of carbon, graphene, graphite, platinum, aluminum, gold, silver, silicon, copper, iron, nickel, stretched polyethylene nanofibers, and mixtures thereof; and a base core layer, wherein the at least one thermally conductive foam layer overlays the base core layer.

17 Claims, 1 Drawing Sheet

(56) References Cited

U.S. PATENT DOCUMENTS

| | | | | |
|---|---|---|---|---|
| 5,800,480 | A * | 9/1998 | Augustine | A61F 7/10 5/421 |
| 6,606,754 | B1 * | 8/2003 | Flick | A47C 21/044 5/421 |
| 7,727,267 | B2 * | 6/2010 | Lachenbruch | A61G 7/057 607/108 |
| 2010/0088818 | A1 | 4/2010 | Rock et al. | |
| 2011/0252562 | A1 * | 10/2011 | Mikkelsen | A47C 21/042 5/421 |
| 2013/0254989 | A1 * | 10/2013 | Garcia | A47C 21/046 5/421 |
| 2014/0039082 | A1 * | 2/2014 | Peterson | C08J 9/0066 521/170 |
| 2014/0141233 | A1 * | 5/2014 | Crawford | C08K 5/03 428/319.7 |
| 2014/0182063 | A1 | 7/2014 | Crawford et al. | |
| 2014/0183403 | A1 * | 7/2014 | Peterson | C09K 5/14 252/75 |
| 2014/0208517 | A1 | 7/2014 | Gross et al. | |
| 2014/0260653 | A1 | 9/2014 | Merrell et al. | |
| 2015/0157136 | A1 * | 6/2015 | Alzoubi | A47C 27/20 5/718 |

FOREIGN PATENT DOCUMENTS

| | | | |
|---|---|---|---|
| CN | 103754337 | A | 4/2014 |
| CN | 103960911 | A | 8/2014 |

OTHER PUBLICATIONS

Written Opinion of the International Searching Authority, issued in International Application No. PCT/US2016/024928, dated Jun. 6, 2016; 5 pages.

Notification Concerning Transmittal of International Preliminary Report on Patentability (Chapter I of the Patent Cooperation Treaty), issued in International Application No. PCT/US2016/024928, dated Oct. 12, 2017; 7 pages.

English Translation of Office Action issued in Chinese Patent Application No. 201680019795.8, dated Oct. 14, 2019: 11 pages.

* cited by examiner

MATTRESS ASSEMBLY INCLUDING THERMALLY CONDUCTIVE FOAM LAYER

CROSS REFERENCE TO RELATED APPLICATIONS

This Non-Provisional application claims the benefit of U.S. Provisional Patent Application Ser. No. 62/141,373 filed on Apr. 1, 2015, which is fully incorporated herein by reference in its entirety.

BACKGROUND

The present disclosure generally relates to mattress assemblies including at least one thermally conductive polymeric elastomer foam layer disposed at the upper or uppermost layers of a one-sided mattress or in the case of a double-sided mattress in both the upper and/or uppermost layer and/or the bottom and/or bottommost layers. More particularly, the present disclosure is directed to polymeric elastomer foam layers including a plurality of thermally conductive particles, the form of which is not intended to be limited.

Foam mattresses such as those formed of polyurethane foam, latex foam, and the like, are generally known in the art. One of the ongoing problems associated with foam mattress assemblies is user comfort. To address user comfort, these mattresses are often fabricated with multiple foam layers having varying properties such as density and hardness, among others, to suit the needs of the intended user. More recently, manufacturers have employed so called memory foam, also commonly referred to as viscoelastic foams, which are generally a combination of polyurethane and one or more additives that increase foam density and viscosity, thereby increasing its viscoelasticity. These foams are often open cell foam structures having both closed and open cells but in some instances may be reticulated foam structures. The term "reticulated" generally refers to a cellular foam structure in which the substantially all of the membrane windows are removed leaving a skeletal structure. In contrast, open cell structures include both open cell (interconnected cells) and closed cells.

When used in a mattress, the memory foam conforms to the shape of a user when the user exerts pressure onto the foam, thereby minimizing pressure points from the user's body. The memory foam then returns to its original shape when the user and associated pressure are removed. Unfortunately, the high density of foams used in current mattress assemblies, particularly those employing memory foam layers, generally prevents proper ventilation. As a result, the foam material can exhibit an uncomfortable level of heat to the user after a period of time. The buildup of heat decreases the thermal gradient between the user and the product resulting in a warm or even a hot feeling. Additionally, these foams can retain a high level of moisture, further causing discomfort to the user and potentially leading to foul odors.

In a mattress or furniture product where the end user is relatively stationary, passive convection has proven to have limited effect on cooling. Active cooling has been practiced but is relatively costly and typically requires a pump or an electrical system. Radiative cooling has been attempted through the use of emissive coatings but is also been met with limited acceptance since these materials are quite costly and only partially effective.

Accordingly, it would be desirable to provide a mattress assembly, especially a mattress including one or more layers of viscoelastic memory foam, with an improved dissipation of user heat.

BRIEF SUMMARY

Disclosed herein are mattress assemblies including at least one thermally conductive foam layer consisting essentially of a polymeric elastomer foam matrix and a plurality of thermally conductive particles disposed therein, wherein the plurality of thermally conductive particles are selected from the group consisting of carbon, graphene, graphite, diamond, platinum, aluminum, gold, silver, silicon, copper, iron, nickel, stretched polyethylene, and mixtures thereof; and a base core layer, wherein the at least one thermally conductive foam layer overlays the base core layer.

A process for dissipating user heat in a mattress includes configuring the mattress with at least one thermally conductive foam layer overlaying a base core layer, the at least one thermally conductive foam layer consisting essentially of a polymeric elastomer foam matrix and a plurality of thermally conductive particles disposed therein, wherein the at least one thermally conductive foam layer is an upper layer or an uppermost foam layer; absorbing user heat from a user's body; and transferring the absorbed heat through to an area of lesser heat to maintain a thermal gradient.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
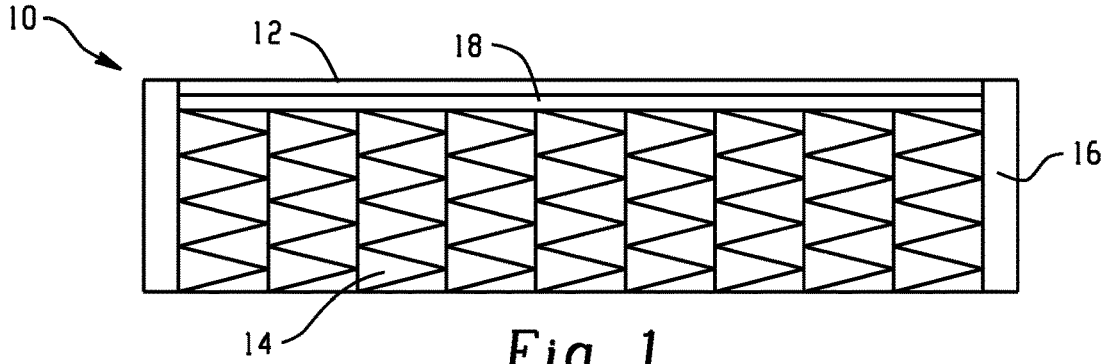
FIG. 1 illustrates a cross sectional view of an exemplary one-sided mattress assembly including at least one thermally conductive foam layer in accordance with an embodiment of the present disclosure.

Disclosed herein are mattress assemblies that provide improved heat dissipation during use. The mattress assemblies generally include at least one layer of thermally conductive polymeric elastomer foam. As will be described in greater detail below, the thermally conductive polymeric elastomer foam layer generally includes a polymeric elastomer foam and a plurality of thermally conductive particles disposed therein. Advantageously, when the at least one layer of thermally conductive polymeric elastomer foam is placed in a mattress assembly proximate to or at a sleeping surface, the thermally conductive polymeric elastomer foam layer acts as a heat sink; absorbing heat from the user's body and transferring the absorbed heat through its structure to an area of lesser heat to maintain a thermal gradient.

As described herein, the mattress assemblies may be a mattress of any size, including standard sizes such as a twin, queen, oversized queen, king, or California king sized mattress, as well as custom or non-standard sizes constructed to accommodate a particular user or a particular room. Additionally, the mattress assemblies can be configured as one sided or two sided mattresses provided the at least one thermally conductive polymeric elastomer foam is placed proximate to or at the sleeping surface.

The mattress assemblies, and any variations thereof, may be manufactured using techniques known in the art of mattress making, with variations to achieve the mattress described above. Likewise, the various mattress layers in the mattress assemblies described above may be adjoined to one another using an adhesive or may be thermally bonded to one another or may be mechanically fastened to one using another hog rings, staples, and/or other techniques known in the art.

Referring now to FIG. ("FIG.") 1, there is depicted a cross sectional view of an exemplary one-sided mattress assembly, which is generally designated by reference numeral 10. The exemplary mattress assembly generally includes an uppermost foam layer 12, and a base core layer 14. The mattress assembly may further include a side rail assembly 16 about at least a portion of the perimeter of the mattress layers 12, 14, and an optional fabric covering (not shown) about at least the side rail assembly as shown, e.g., a mattress border. In some embodiments, the optional fabric covering may overlay the uppermost foam layer 12 and extend about the perimeter. The uppermost foam layer 12 is generally referred to herein as the cover layer and has a planar top surface adapted to substantially face the user resting on the mattress assembly and having a length and width dimensions sufficient to support a reclining body of the user.

In some embodiments, there may be one or more intermediate layers 18 sandwiched between the base core layer 14 and the uppermost foam layer 12. In the present disclosure, the thermally conductive polymeric elastomer foam layer may be any one or more of the uppermost foam layer 12 and the intermediate layers 18, if present. For one sided mattresses, the thermally conductive polymeric elastomer foam layer overlays the base core layer 14.

Figure 2:
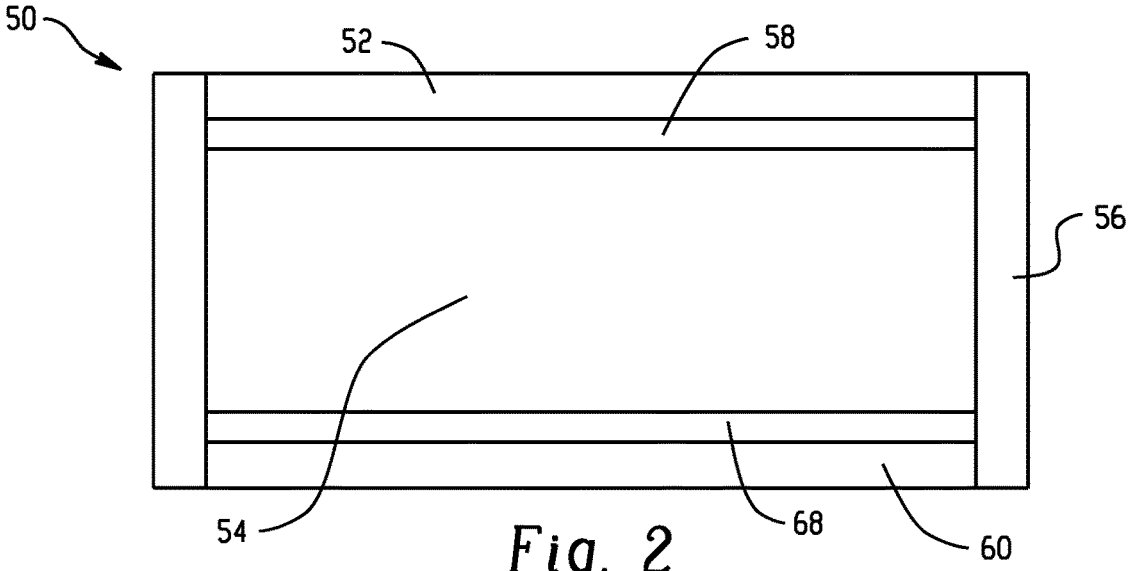
FIG. 2 illustrates a top down view of an exemplary two-sided mattress assembly including at least one thermally conductive foam layer in accordance with an embodiment of the present disclosure.

Referring now to FIG. 2, there is depicted a cross sectional view of an exemplary two-sided mattress assembly, which is generally designated by reference numeral 50. Relative to ground level, the exemplary mattress assembly generally includes base core layer 54, an uppermost foam layer 52 overlaying the base core layer 54, and a lowermost layer 60 disposed below the base core layer 54. The mattress assembly may further include a side rail assembly 56 about at least a portion of the perimeter of the mattress layers and an optional fabric covering (not shown) about at least the side rail assembly as shown, e.g., a mattress border. In some embodiments, the optional fabric covering may overlay the uppermost foam layer 52 and extend about the perimeter including the perimeter of the lowermost layer 60. The uppermost foam layer 52 and the lowermost layer 60 are adapted to substantially face the user resting on the mattress assembly depending on the orientation of the mattress assembly and have a length and width dimensions sufficient to support a reclining body of the user. Similar to the one-sided mattress assembly 10 described above, in some embodiments there may be one or more intermediate layers 58, 68 sandwiched between the base core layer 54 and the uppermost foam layer 12 or the bottommost layer 60. In the present disclosure, the thermally conductive polymeric elastomer foam layer may be any one or more of the uppermost foam layer 52, and the intermediate layers 58, if present, and the lowermost foam layer 60, and the intermediate layers 68. That is, there is at least one thermally conductive foam layer on each side of the base core layer 54.

While discussion will continue with respect to the thermally conductive polymeric elastomer layer and their use in mattress assemblies, it is to be understood that the base core layers 14, 54 of the mattress assemblies described above can be any suitable base known to those having skill in the art. The base core layer 14, 54 can be a standard spring support unit (e.g., a pocketed coil base or an innerspring assembly such as is shown in FIG. 1) or, alternatively, the layer can be formed of foam, e.g., a polyurethane foam, although other foams can be used, including without limitation, viscoelastic foams, or a hybrid thereof. In one embodiment, the base core layer is an open cell polyurethane foam. In other embodiments, the base core layer is closed cell polyurethane foam.

The coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment, e.g., the coil springs may optionally be encased, i.e., pocketed, in an envelope or an open coil and arranged in rows. For example, pocket coils are commonly attached to one another using hot-melt adhesive applied to abutting surfaces during construction.

The construction of the coil spring layer may be a plurality of rows of parallel coils with the coils aligned in columns so that the coils line up in both longitudinal and lateral directions or they may be nested in a honeycomb configuration, wherein coils in one row are offset from coils in an adjacent row as is generally known in the art. Adjacent spring coils may be connected with adhesive. Alternatively, adjacent spring coils may be connected with a hog ring or other metal fasteners.

As is generally known in the art, the coils can be of any diameter; be symmetrical or asymmetrical, be designed with linear and/or non-linear behavior, or the like as may be desired for the different intended applications. In one embodiment, the length of the coil springs range from 1 to 10 inches; and 2 to 6 inches in other embodiments.

Figure 3:
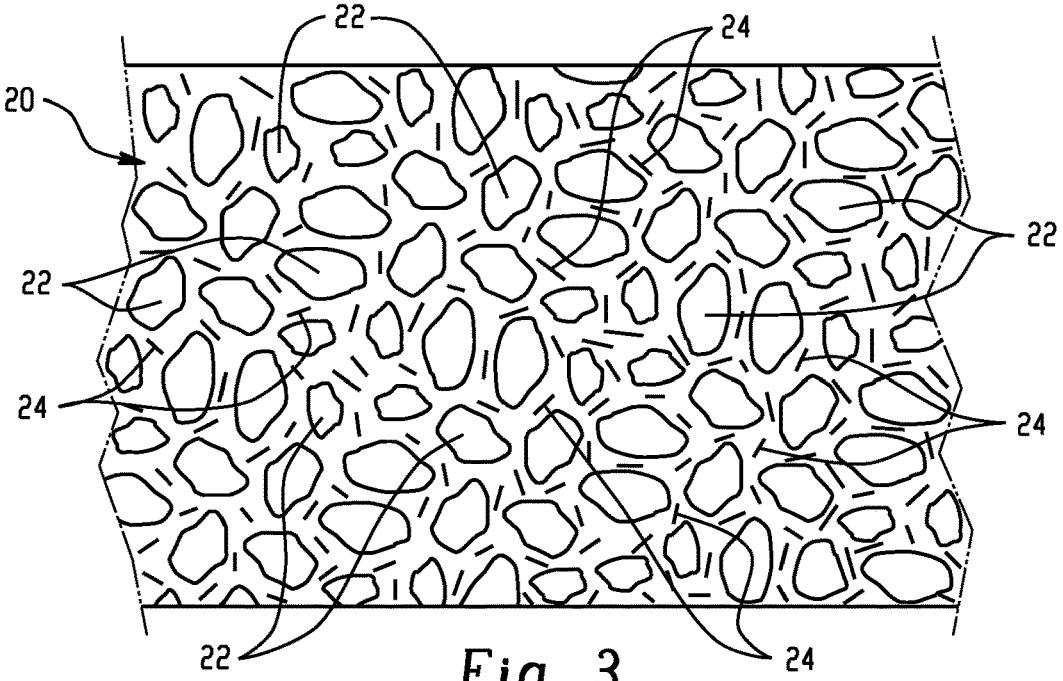
FIG. 3 illustrates a cross sectional view of a mattress assembly taken along line 1-1 of FIG. 1 in accordance with an embodiment of the present disclosure.

As shown in the enlarged sectional view of FIG. 3, the thermally conductive polymeric elastomer foam layer, e.g., layer 12, includes a polymeric elastomer foam matrix 20 including a plurality of voids 22 and a plurality of thermally conductive fillers 24, which are depicted as fibers, disposed within the matrix.

The matrix may be any polymeric elastomer that retains its shape after deformation and includes voids, i.e., pores, throughout the matrix. Exemplary polymeric elastomers include, but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic foam materials are also temperature sensitive, thereby enabling the foam layer to change hardness/firmness based in part upon the temperature of the supported part, e.g., person. Unless otherwise noted, any of these foams may be open celled or closed cell or a hybrid structure of open cell and closed cell. Likewise, the foams can be reticulated, partially reticulated or non-reticulated foams. The term reticulation generally refers to removal of cell membranes to create an open cell structure that is open to air and moisture flow. Still further, the foams may be gel-infused in some embodiments in addition to the incorporation of the thermally conductive fibers. The different layers can be formed of the same material configured with different properties or different materials. These same materials can be used for any of the foam layers that do not include the thermally conductive fibers incorporated therein, e.g., in the case of a foam base core layer, the layer may be composed of polyurethane foam.

The various foams suitable for use in the thermally conductive polymeric elastomer foam layer may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well-known Dunlap or Talalay processes. The thermally conductive fibers can be added during polymerization, prior to curing, prior to forming the voids, or the like. Manufacturing of the different foams are well within the skill of those in the art. It should be apparent to those skilled in the art of foam manufacturing that the distribution of the thermally conductive fibers may be heterogeneous, homogenous, stratified, or the like. By way of example, a homogenous distribution would maintain a thermal gradient through the thickness of the layer providing a pathway for heat transfer for the surface closest to the sleeping surface to the interior, i.e., towards the base core layer. An example of a heterogeneous structure, e.g., stratified, may include heavier loading of the conductive filler or stabilizer at a surface of the polymer material. This implementation would provide improved thermal transfer across the surface of the polymer layer.

The different properties for each layer defining the foam may include, but are not limited to, density, hardness, thickness, support factor, flex fatigue, air flow, various combinations thereof, and the like. Density is a measurement of the mass per unit volume and is commonly expressed in pounds per cubic foot. By way of example, the density of the each of the foam layers can vary. In some embodiments, the density decreases from the lower most individual layer to the uppermost layer. In other embodiments, the density increases. In still other embodiments, one or more of the foam layer can have a convoluted surface. The convolution may be formed of one or more individual layers with the foam layer, wherein the density is varied from one layer to the next. The hardness properties of foam are also referred to as the indention load deflection (ILD) or indention force deflection (IFD) and are measured in accordance with ASTM D-3574. Like the density property, the hardness properties can be varied in a similar manner. Moreover, combinations of properties may be varied for each individual layer. The individual layers can also be of the same thickness or may have different thicknesses as may be desired to provide different tactile responses.

The hardness of the layers generally have an indention load deflection (ILD) of 7 to 16 pounds force for viscoelastic foams and an ILD of 7 to 45 pounds force for non-viscoelastic foams. ILD can be measured in accordance with ASTM D 3575. The density of the layers can generally range from about 1 to 2.5 pounds per cubic foot for non-viscoelastic foams and 1.5 to 6 pounds per cubic foot for viscoelastic foams.

Suitable thermally conductive fillers include various fibers, powder, flakes, needles, and the like dispersed within the foam matrix. In one embodiment, the thermally conductive fillers are nanoparticles with at least one dimension that measures 1000 nanometers or less, e.g., nanowires, and nanostrands.

The thermally conductive fillers can be formed of metals, metal oxides, polymers, inorganic compounds and the like. By way of example, suitable materials may be made of carbon, graphene, graphite, platinum, aluminum, diamond, gold, silver, silicon, copper, iron, nickel, and the like; polymers such as stretched polyethylene nanofibers; and the like, and mixtures thereof. In most embodiments, the selected material has a thermal conductivity greater than 10 watts per meters-Kelvin (W/m*K). By way of example, aluminum has a thermal conductivity of about 235 W/m*K; stretched polyethylene fibers is estimated to be about 180 W/m*K, and graphene has a theoretical conductivity of about 5000 W/m*K.

In some implementations, the polymeric elastomer used as the foam matrix may be capable of being mixed with the thermally conductive particles prior to curing. For example, some elastomeric polymers may be thermoset, or irreversibly cured via heat, a chemical reaction, or irradiation. Prior to curing, the thermally conductive particles may be combined with the uncured polymeric elastomer. For example, a polymeric elastomer cured via a chemical reaction, such as foam, may include two parts, the polymeric elastomer being formed when the two parts are mixed or combined. Once combined, the two parts chemically react, generating the air pockets or voids characteristic of foam, and harden. The thermally conductive particles may be mixed with one or both parts prior to combining. Some polymeric elastomers may be mixed with a foaming agent prior to curing. Such polymeric elastomer may be combined with the thermally conductive particles prior to mixing with the foaming agent. Voids may be formed in the polymeric elastomer by gas injection, by whipping, and the like. Some polymeric elastomers may be cured via heat. Thermoset polymeric elastomers may be cast, molded, sprayed or extruded after mixing and before they cure.

The thermally conductive filler loading will generally depend on the foam matrix, the filler form, and the inherent thermal conductivity of the filler material incorporated in the foam matrix. The amount selected can be from greater than zero weight percent to less than about 75 weight percent, wherein the filler weight percent is based on net weight of foam. In some embodiments, a gradient of the thermally conductive filler material within the foam matrix is provided. The gradient may increase from the top of the foam layer to the bottom of the foam layer, wherein top and bottom refer to orientation of the foam layer relative to a sleeping surface of the mattress such that the top surface is adapted to substantially face the user resting upon the bed mattress. In other embodiments, the gradient may decrease from the top of the foam layer to the bottom of the foam layer Advantageously, improved thermal conductivity of the foam layer would provide increased heat flux from the user surface assisting in the transmission of heat and the reduction of heat buildup at the user surface. When used in a mattress or seating product the foam with thermally conductive particles would transfer heat from the user surface to the interior of the product. Heat would eventually exhaust through the breathable layers of the product maintaining a high enough heat flux to retard heat buildup.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly, comprising:

at least one thermally conductive foam layer consisting essentially of a polymeric elastomer foam matrix and a plurality of thermally conductive particles dispersed throughout the polymeric elastomer foam matrix, wherein the plurality of thermally conductive particles are selected from the group consisting of stretched polyethylene, and mixtures thereof, and wherein the plurality of thermally conductive particles in the polymeric elastomer foam matrix define a gradient having a concentration of thermally conductive particles increasing or decreasing from a top surface to a bottom surface of the thermally conductive foam layer; and a base core layer, wherein the at least one thermally conductive foam layer overlays the base core layer.

2. The mattress assembly of claim 1, further comprising at least one thermally conductive foam layer underlaying the base core layer.

3. The mattress assembly of claim 1, wherein the base core layer comprises an innerspring assembly.

4. The mattress assembly of claim 1, wherein the base core layer comprises one or more foam layers.

5. The mattress assembly of claim 1, wherein the polymeric elastomer foam matrix is a viscoelastic foam.

6. The mattress assembly of claim 1, wherein the polymeric elastomer foam matrix is gel-infused.

7. The mattress assembly of claim 1, wherein the plurality of thermally conductive particles are nanofibers.

8. The mattress assembly of claim 1, wherein the at least one thermally conductive foam layer overlaying the base core layer is an uppermost layer adapted to substantially face the user resting upon the bed mattress.

9. The mattress assembly of claim 1, wherein the at least one thermally conductive foam layer overlaying the base core layer is an uppermost foam layer and/or a foam layer intermediate the uppermost layer and the base core layer.

10. The mattress assembly of claim 1, wherein the mattress is one sided and the at least one thermally conductive foam layer overlaying the base core layer is an uppermost foam layer and/or a foam layer intermediate the uppermost layer and the base core layer.

11. The mattress assembly of claim 1, wherein the mattress is two-sided comprising at least one thermally conductive foam layer overlaying the base core layer and at least one thermally conductive foam layer underlaying the base core layer.

12. The mattress assembly of claim 1, wherein the thermally conductive particles comprise powders or fibers or flakes, or needles or combinations thereof.

13. A process for dissipating user heat in a mattress, the process comprising:

configuring the mattress with at least one thermally conductive foam layer overlaying a base core layer, the at least one thermally conductive foam layer consisting essentially of a polymeric elastomer foam matrix and a plurality of thermally conductive stretched polyethylene particles and mixtures thereof dispersed throughout the polymeric elastomer foam matrix, wherein the at least one thermally conductive foam layer is an upper layer or an uppermost foam layer;

absorbing user heat from a user's body; and transferring the absorbed heat through to an area of lesser heat to maintain a thermal gradient.

14. The process of claim 13, wherein the mattress is one sided and the at least one thermally conductive foam layer overlaying the base core layer is an uppermost foam layer and/or a foam layer intermediate the uppermost layer and the base core layer.

15. The process of claim 13, wherein the mattress is two-sided comprising at least one thermally conductive foam layer overlaying the base core layer and at least one thermally conductive foam layer underlaying the base core layer.

16. The process of claim 13, wherein the base core layer comprises an innerspring assembly.

17. The process of claim 13, wherein the base core layer comprises one or more foam layers.

* * * * *